US009195199B2

(12) United States Patent
Aoki

(10) Patent No.: US 9,195,199 B2
(45) Date of Patent: Nov. 24, 2015

(54) IMAGE FORMING APPARATUS, IMAGE FORMING SYSTEM, AND IMAGE FORMING METHOD

(71) Applicant: KONICA MINOLTA INC, Chyoda-ku (JP)

(72) Inventor: Shingo Aoki, Sagamihara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/535,815

(22) Filed: Nov. 7, 2014

(65) Prior Publication Data

US 2015/0132016 A1 May 14, 2015

(30) Foreign Application Priority Data

Nov. 13, 2013 (JP) ..... 2013-234583

(51) Int. Cl.

| | |
|---|---|
| ***G03G 15/00*** | (2006.01) |
| ***B65H 7/10*** | (2006.01) |
| ***B65H 9/00*** | (2006.01) |
| ***B65H 23/038*** | (2006.01) |
| *G03G 15/043* | (2006.01) |

(52) U.S. Cl.

CPC ..... *G03G 15/6567* (2013.01); *B65H 7/10* (2013.01); *B65H 9/002* (2013.01); *B65H 23/038* (2013.01); *G03G 15/043* (2013.01); *G03G 2215/00561* (2013.01); *G03G 2215/00721* (2013.01)

(58) Field of Classification Search

CPC ..... G03G 15/6558; G03G 15/6561; G03G 15/6567; G03G 2215/00561; G03G 2215/00405; G03G 2215/00721; B65H 7/10; B65H 23/032; B65H 23/038; B65H 9/02; B65H 9/002

See application file for complete search history.

(56) References Cited

U.S. PATENT DOCUMENTS

| | | | | |
|---|---|---|---|---|
| 2010/0272487 | A1* | 10/2010 | Krucinski | 399/395 |
| 2011/0132957 | A1* | 6/2011 | Kawaguchi et al. | 226/27 |
| 2011/0311240 | A1* | 12/2011 | Shirakata | 399/16 |
| 2014/0050494 | A1* | 2/2014 | Kawanago | 399/16 |

FOREIGN PATENT DOCUMENTS

| | | | |
|---|---|---|---|
| JP | 08-230231 | A | 9/1996 |

* cited by examiner

*Primary Examiner* — Blake A Tankersley

(74) *Attorney, Agent, or Firm* — Buchanan Ingersoll & Rooney PC

(57) ABSTRACT

An image forming apparatus includes: a transfer part configured to transfer an unfixed toner image transferred from a photosensitive member onto a recording medium; a pair of pre-transfer rollers configured to convey a recording medium toward the transfer part; a fixing part configured to make the recording medium onto which the toner image is transferred pass between a pair of fixing rollers to fix the toner image onto the recording medium; a first detection sensor configured to detect a position of the recording medium between the transfer part and the pair of pre-transfer rollers; a second detection sensor configured to detect a position of the recording medium downstream of the pair of pre-transfer rollers; and a controller configured to calculate a deviation amount of the recording medium, rock the pair of pre-transfer rollers and adjust a position to which an image is written to form a toner image.

17 Claims, 11 Drawing Sheets

IMAGE FORMING APPARATUS, IMAGE FORMING SYSTEM, AND IMAGE FORMING METHOD

The entire disclosure of Japanese Patent Application No. 2013-234583 filed on Nov. 13, 2013 including description, claims, drawings, and abstract are incorporated herein by reference in its entirety.

BACKGROUND OF THE INVENTION

1. Field of the Invention

The present invention relates to an image forming apparatus, an image forming system, and an image forming method for correcting a deviation of position to which an image is transferred caused by meandering of a recording medium such as a sheet.

2. Description of the Related Art

In an image forming apparatus, a charged photosensitive member is exposed on the basis of image data to form an electrostatic latent image, and a developer (toner) is made to adhere to the photosensitive member to develop the electrostatic latent image into a toner image. The toner image is then transferred to a recording medium such as a sheet (hereinafter referred to as a sheet), and the sheet onto which the toner image is transferred is heated and pressure is applied thereto by a fixing roller to fix the toner image on the sheet.

In such an image forming apparatus, if a sheet is deviated and passes a transfer position in a state in which the sheet is deviated to one side from a reference position, a problem that the position of the image transferred onto the sheet is deviated is caused. Furthermore, when a long sheet that is conveyed for transfer in a state in which the sheet is held between pre-transfer rollers, by a secondary transfer part and between fixing rollers at the same time is used, the sheet is likely to meander owing to the difference in the roller diameter.

In this regard, a technology for detecting a deviation of a sheet being conveyed to correct the position to which an image is to be written is proposed (refer to JP 8-230231 A). In the image forming apparatus disclosed in JP 8-230231 A, detection of the position of an end of a sheet is also performed while the sheet is being conveyed so that the write position is always corrected when a deviation occurs.

For detecting a deviation of a sheet being conveyed and correcting a position to which an image is to be written, the angle of the image (vertical magnification and horizontal magnification) needs to be changed according to the meandering angle of the sheet when the meandering sheet passes through a transfer position at an angle from a reference position. Thus, write control of images is complicated and correction of an image with respect to the sheet is difficult. As a result, the accuracy of the image position with respect to the sheet is not stable.

SUMMARY OF THE INVENTION

In view of the above, an object of the present invention is to provide an image forming apparatus, an image forming system, and an image forming method capable of writing an image with high accuracy even when a sheet meanders.

To achieve at least one of the abovementioned objects, according to an aspect, an image forming apparatus and an image forming system reflecting one aspect of the present invention comprises a transfer part, a pair of pre-transfer rollers, a fixing part, a first detection sensor, a second detection sensor, and a controller. The transfer part carries an unfixed toner image transferred from a photosensitive member and transfers the toner image onto a recording medium.

The pair of pre-transfer rollers is provided upstream of the transfer part to convey a recording medium toward the transfer part. The fixing part is provided downstream of the transfer part and makes the recording medium carrying a toner image thereon pass between a pair of fixing rollers to fix the toner image onto the recording medium. The first detection sensor is provided between the transfer part and the pair of pre-transfer rollers and configured to detect a position of the recording medium between the transfer part and the pair of pre-transfer rollers. The second detection sensor is provided downstream of the transfer part and configured to detect a position of the recording medium downstream of the pair of pre-transfer rollers. The controller is configured to calculate a deviation amount of the recording medium from values detected by the first detection sensor and the second detection sensor, rocks the pair of pre-transfer rollers and adjusts a position on the photosensitive member to which an image is to be written on the basis of the deviation amount.

To achieve at least one of the abovementioned objects, according to an aspect, an image forming method reflecting one aspect of the present invention used in the image forming apparatus described above comprises detecting a position of a recording medium held by a transfer part, between a pair of pre-transfer rollers, and between a pair of fixing rollers by a first detection sensor and a second detection sensor. Subsequently, a deviation amount of the recording medium is calculated from values detected by the first detection sensor and the second detection sensor. Subsequently, the pair of pre-transfer rollers is rocked and a position on the photosensitive member to which an image is to be written is adjusted on the basis of the deviation amount.

With the image forming apparatus, the image forming system, and the image forming method according to the present invention, a meandering state of a sheet held between the pair of pre-transfer rollers, by the transfer part, and between the pair of fixing rollers is detected by the first detection sensor and the second detection sensor. The pair of pre-transfer rollers is then rocked to correct a deviation of the recording medium. Furthermore, the position on the photosensitive member to which the image is written is adjusted to suppress a deviation of the transfer position that is the position of the image transferred to the recording medium

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, examples of an image forming apparatus, an image forming system and an image forming method according to embodiments of the present invention will be described with reference to the drawings. Note that the present invention is not limited to the following examples.

1. First Embodiment

Image Forming Apparatus Configured to Correct Position of Sheet by Rocking Pre-Transfer Rollers

[1-1. Overall Configuration of Image Forming Apparatus]

Figure 1:
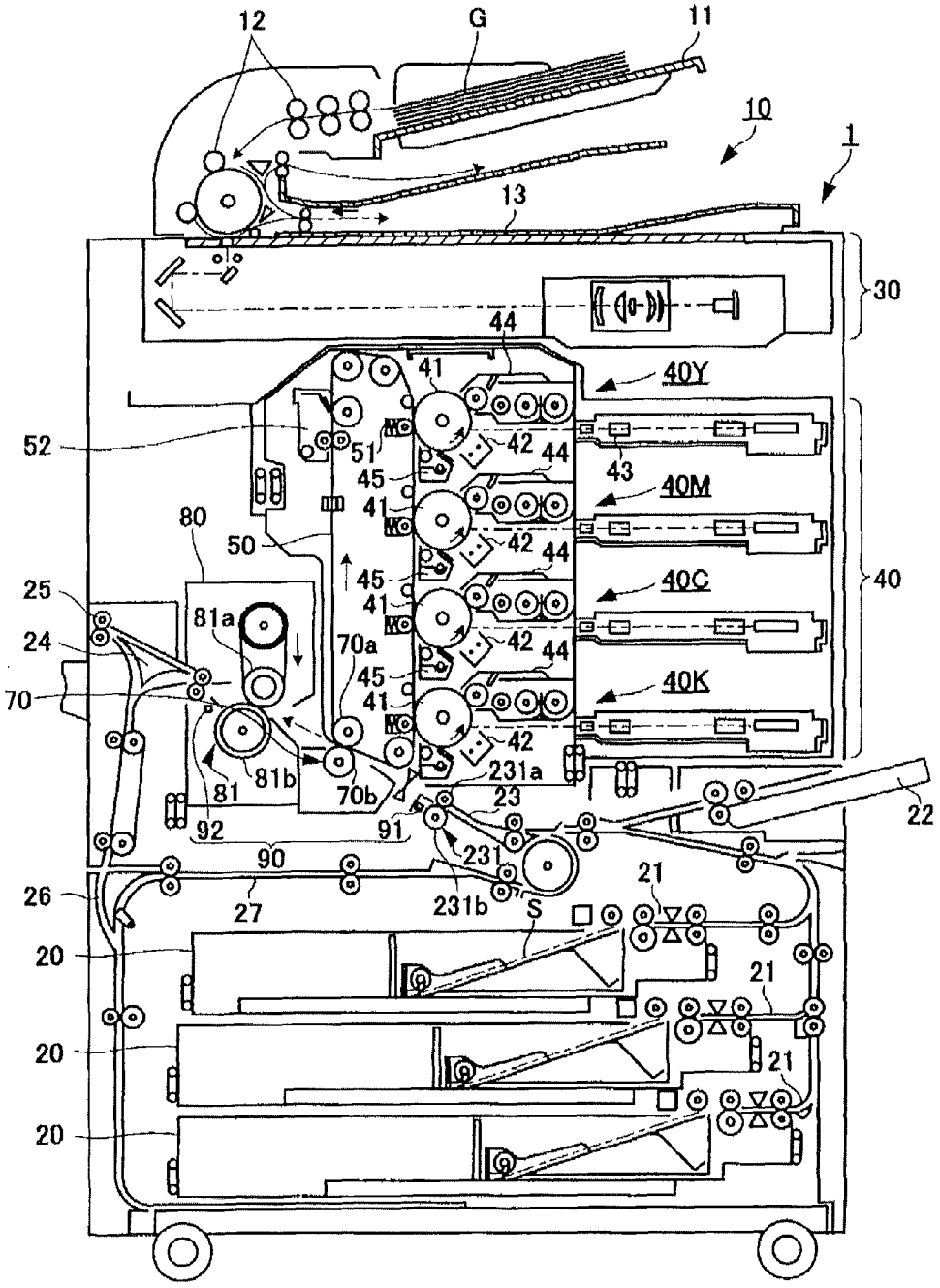
FIG. 1 is a schematic configuration diagram of an image forming apparatus according to a first embodiment of the present invention.

FIG. 1 is a schematic configuration diagram of an image forming apparatus 1 according to a first embodiment of the present invention. The image forming apparatus 1 according to the present embodiment forms an image on a sheet by using the electrophotographic system, and is a tandem color image forming apparatus that overlays four color toners of yellow (Y), magenta (M), cyan (C), and black (Bk) on one another.

As shown in FIG. 1, the image forming apparatus 1 of the present embodiment includes an original document conveyor 10, a sheet accommodation part 20, an image reading part 30, an image forming part 40, an intermediate transfer belt 50, a conveyor 23, a secondary transfer part 70, a fixing part 80, and a sheet position detection sensor 90.

The original document conveyor 10 has an original document feeder 11 on which an original document is set, and multiple rollers 12. An original document G set on the original document feeder 11 in the original document conveyor 10 is conveyed sheet by sheet to a reading position in the image reading part 30 by the rollers 12. The image reading part 30 reads images of the original document G convey by the original document conveyor 10 or the original document placed on an original document plate 13, and generates image signals.

The sheet accommodation part 20 is positioned at a lower portion of an apparatus main body, and more than one sheet accommodation parts 20 may be provided depending on the sizes of sheets S. The sheets S are fed by a sheet feeder 21 and transferred to the conveyor 23. In addition, a manual sheet feeder 22 is provided near the sheet accommodation part 20. Sheets of a size that are not accommodated in the sheet accommodation part 20, tag sheets containing tags, and special paper such as OHP sheets are transferred from the manual sheet feeder 22 to a transfer position.

The conveyor 23 is provided upstream of the secondary transfer part 70, and includes conveyance rollers, and a pair of registration rollers 231 (a pair of pre-transfer rollers in the present invention) provided near the secondary transfer part 70. The pair of registration rollers 231 is a pair of rollers including a driving roller 231*b* and a driven roller 231*a* arranged in a state in which the driven roller 231*a* is pressed against an upper side of the driving roller 231*b*. In addition, a nip portion between the driving roller 231*b* and the driven roller 231*a* is a conveyance path for sheets S.

A sheet S fed by the feeder 21 and delivered to the conveyor 23 is conveyed to the secondary transfer part 70 that is the transfer position by the conveyance rollers and the pair of registration rollers 231. The pair of registration rollers 231 feeds out a sheet S to the secondary transfer part 70 at a timing when transfer of a toner image can be carried out at the secondary transfer part 70. Furthermore, the pair of registration rollers 231 is capable of rocking movement in the axial direction of the driven roller 231*a* and the driving roller 231*b*. A rocking mechanism of the pair of registration rollers 231 will be described later.

The image forming part 40 and the intermediate transfer belt 50 are arranged between the image reading part 30 and the sheet accommodation part 20. The image forming part 40 includes four image forming units 40Y, 40M, 40C, and 40K to form toner images of yellow (Y), magenta (M), cyan (C), and black (Bk).

The first image forming unit 40Y forms an yellow toner image, and the second image forming unit 40M forms a magenta toner image. The third image forming unit 40C forms a cyan toner image, and the fourth image forming unit 40K forms a black toner image. Since these four image forming units 40Y, 40M, 40C, and 40K have the same structure, the first image forming unit 40Y will be described herein as a representative thereof.

The first image forming unit 40Y includes a drum-shaped photosensitive member 41, a charging portion 42 positioned around the photosensitive member 41, an exposure portion 43, a developing portion 44, and a cleaning portion 45. The photosensitive member 41 rotates in the counterclockwise direction by a drive motor (not shown). The charging portion 42 applies an electric charge to the photosensitive member 41 to uniformly charge the surface of the photosensitive member 41. The exposure portion 43 performs exposure of the surface of the photosensitive member 41 on the basis of image data read from an original document G to form an electrostatic latent image on the photosensitive member 41.

The developing portion 44 makes yellow toner adhere to the electrostatic latent image formed on the photosensitive member 41. As a result, a yellow toner image is formed on the surface of the photosensitive member 41. Note that the developing portion 44 of the second image forming unit 40M makes magenta toner adhere to the photosensitive member 41, and the developing portion 44 of the third image forming unit 40C makes cyan toner adhere to the photosensitive member 41. In addition, the developing portion 44 of the fourth image forming unit 40K makes black toner adhere to the photosensitive member 41

The toner adhering to the photosensitive member 41 is transferred to the intermediate transfer belt 50. The cleaning portion 45 removes toner remaining on the surface of the photosensitive member 41 after transfer to the intermediate transfer belt 50.

The intermediate transfer belt 50 is formed endlessly and rotates in the clockwise direction opposite to the rotating direction of the photosensitive member 41 by a drive motor (not shown). Primary transfer parts 51 are provided at positions on the intermediate transfer belt 50 opposed to the photosensitive members 41 of the respective image forming units 40Y, 40M, 40C, and 40K. Each of the primary transfer part 51 applies an electric charge of the polarity opposite to that of the toner to the intermediate transfer belt 50 to transfer the toner image formed on the photosensitive member 41 to the intermediate transfer belt 50.

As the intermediate transfer belt 50 rotates, the toner images formed by the four image forming units 40Y, 40M, 40C, and 40K are sequentially transferred onto the surface of the intermediate transfer belt 50. As a result, the toner images of yellow, magenta, cyan, and black are overlaid on one another to form a color image on the intermediate transfer belt 50.

The secondary transfer part 70 (a transfer part of the present invention) is arranged near the intermediate transfer belt 50 and downstream of the conveyor 23. The secondary transfer part 70 is constituted by a pair of transfer rollers including an upper transfer roller 70*a* around which the intermediate transfer belt 50 is looped in a tensioned state and a lower transfer roller 70*b* pressed toward the upper transfer roller 70*a* with the intermediate transfer belt 50 therebetween. At the secondary transfer part 70, a sheet S transferred by the conveyor 23 between the pair of registration rollers 231 is pressed toward the intermediate transfer belt 50 by the lower transfer roller 70*b*. The secondary transfer part 70 then transfers the color toner images formed on the intermediate transfer belt 50 onto the sheet S conveyed from the conveyor 23. A cleaning portion 52 removes toner remaining on the surface of the intermediate transfer belt 50 after transfer to the sheet S.

The fixing part 80 is provided downstream (on a discharge side) of the secondary transfer part 70 in the direction in which a sheet S is conveyed, and has a pair of fixing rollers 81 including an upper fixing roller 81*a* and a lower fixing roller 81*b*. At the fixing part 80, the sheet S with an unfixed toner image is pressed and heated while being held between the upper fixing roller 81*a* and the lower fixing roller 81*b*, so that the toner image is fixed onto the sheet S.

The sheet position detection sensor 90 is constituted by a first detection sensor 91 and a second detection sensor 92, and is configured to detect a deviation of a sheet S held between the pair of registration rollers 231, by the secondary transfer part 70, and between the pair of fixing rollers 81. A detected value is sent to a controller 260 (see FIG. 2), which controls rocking movement of the pair of registration rollers 231 and the position of the photosensitive member 41 onto which an image (electrostatic latent image) is written on the basis of the detected value. The configuration of the sheet position detection sensor 90 and the method for controlling the rocking movement of the pair of registration rollers 231 and the position to which the image is written will be described in detail later.

A switching gate 24 is arranged downstream of the fixing part 80. The switching gate 24 switches the conveyance path of a sheet S that has passed through the fixing part 80. Specifically, the switching gate 24 makes the sheet S go straight when the sheet S is to be discharged face up in one-side image formation. As a result, the sheet S is discharged by a pair of discharge rollers 25. In addition, the switching gate 24 guides the sheet S downward when the sheet S is to be discharged face down, that is, with the face on which the image is formed facing downward, in one-side image formation or in double-side image formation.

When the sheet S is to be discharged face down, the sheet S is guided downward by the switching gate 24, then reversed upside down and conveyed upward by a sheet reversing conveyor 26. As a result, the sheet S is discharged by the pair of discharge rollers 25. For double-side image formation, the sheet S is guided downward by the switching gate 24, then reversed upside down and by the sheet reversing conveyor 26, and delivered to the transfer position again through a refeeding path 27.

Furthermore, a post-processing device for folding sheets S, stapling sheets S, and the like may be provided downstream of the pair of discharge rollers 25.

[1-2. Configuration of Main Part]

Figure 2:
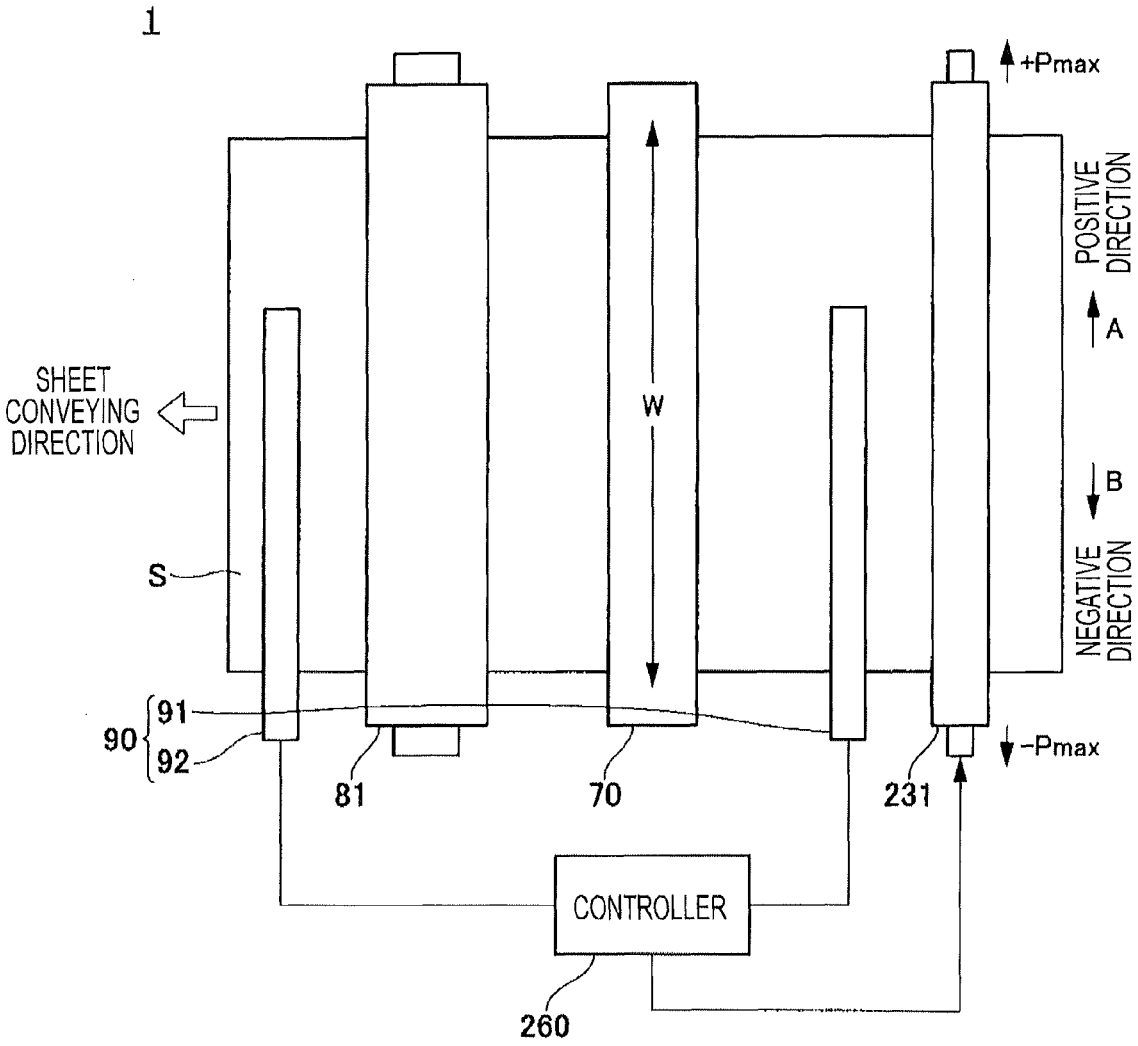
FIG. 2 is a top view of a main part including a sheet position detection sensor according to the first embodiment, which is partially shown in a block diagram.

Next, a configuration of a main part of the image forming apparatus 1 of the present embodiment will be described in detail. FIG. 2 is a top view of the main part including the sheet position detection sensor 90, which is partially shown in a block diagram. In FIG. 2, parts corresponding to those in FIG. 1 are represented by the same reference numerals. Furthermore, for easier understanding of the description, the direction indicated by an arrow A in FIG. 2 will be referred to as a positive direction and the direction indicated by an arrow B will be referred to as a negative direction.

The first detection sensor 91 is arranged between the secondary transfer part 70 and the pair of registration rollers 231, and driven and controlled by the controller 260. The first detection sensor 91 has functions as a deviation detector to detect a deviation of a conveyed sheet S from a reference position. The first detection sensor 91 periodically reads the position at one end of a sheet S in parallel to the conveying direction of the sheet S, and outputs the read information to the controller 260. The controller 260 calculates the deviated position relative to the reference position of the sheet S on the basis of information received from the first detection sensor 91.

The second detection sensor 92 is arranged near the pair of fixing rollers 81 and downstream of the pair of fixing rollers 81, and is driven and controlled by the controller 260. Similarly to the first detection sensor 91, the second detection sensor 92 has functions as a deviation detector to detect a deviation of a conveyed sheet S from a reference position. The second detection sensor 92 periodically reads the position at one end of a sheet S in parallel to the conveying direction of the sheet S, and outputs the read information to the controller 260. The controller 260 calculates the deviated position relative to the reference position of the sheet S on the basis of information received from the second detection sensor 92.

For the first detection sensor 91 and the second detection sensor 92, line sensors having multiple photoelectric transducers arranged in a straight line along the sheet width perpendicular to the conveying direction of sheets S or image sensors having photoelectric transducers arranged in a matrix are used. Examples of the line sensors and images sensors include CCD image sensors, and CMOS (including MOS) image sensors.

The controller 260 calculates a difference between a deviated position of a sheet S calculated on the basis of a detected value detected by the first detection sensor 91 and a deviated position of the sheet S calculated on the basis of a detected value detected by the second detection sensor 92. The controller 260 then adjusts the rocking movement of the pair of registration rollers 231 and the position of the photosensitive member 41 to which an image is to be written or stops a job depending on the amount of the difference. The control method will be described in detail later.

Although not shown in FIG. 2, a registration rocking mechanism to rock the pair of registration rollers 231 in the direction perpendicular to the conveying direction of sheets S is provided at an end of a shaft of each of the rollers constituting the pair of registration rollers 231. The registration rocking mechanisms thus rock the pair of registration rollers 231 in the axial direction on the basis of a signal sent from the controller 260. Herein, a maximum width by which the pair of registration rollers 231 can be rocked in the positive direction is represented by +Pmax, and a maximum width by which the pair of registration rollers 231 can be rocked in the negative direction is represented by −Pmax. Note that the maximum widths +Pmax and −Pmax are assumed to be "positive" values.

Figure 3:
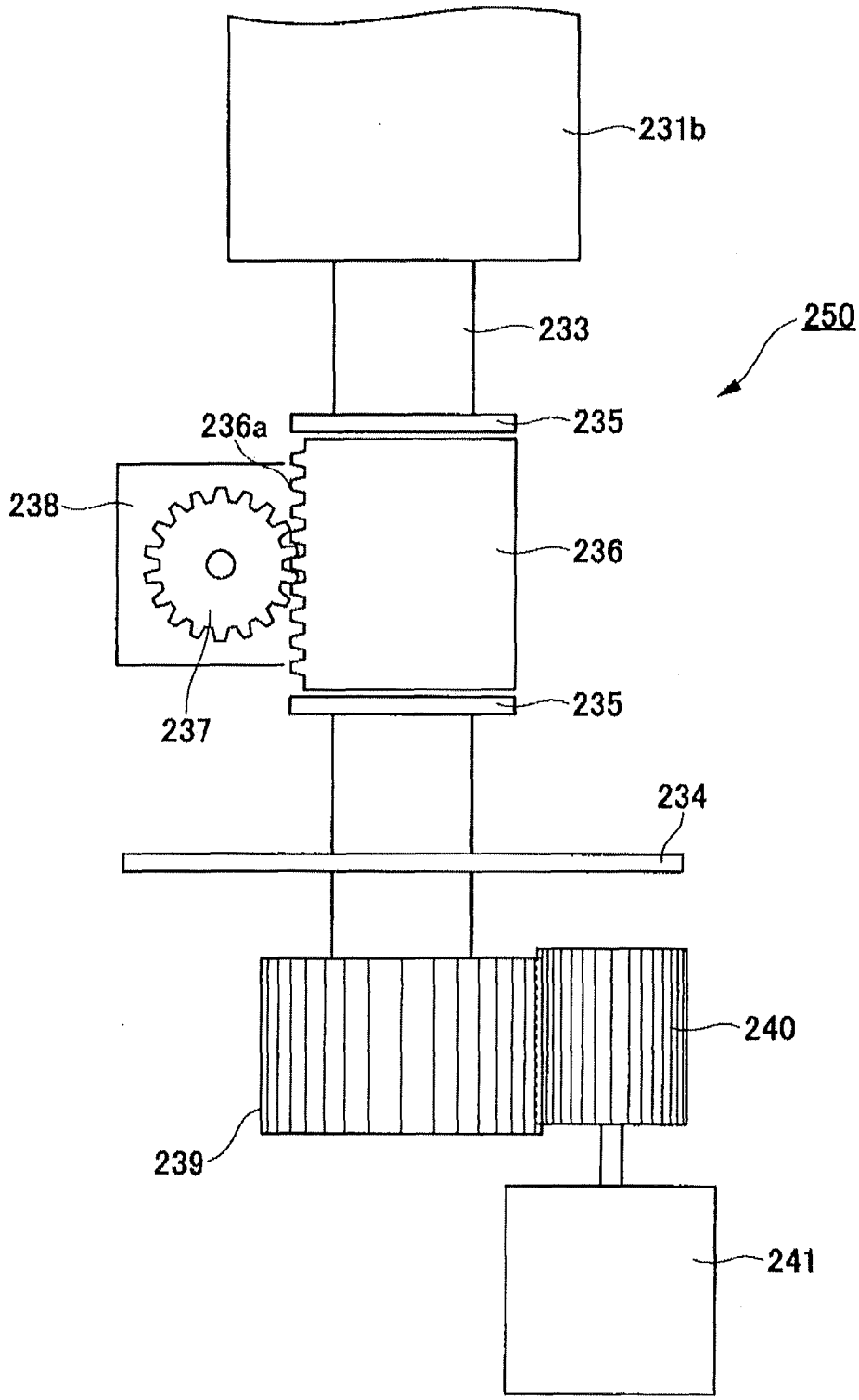
FIG. 3 is a schematic configuration diagram of a registration rocking mechanism.

FIG. 3 is a schematic configuration diagram of a registration rocking mechanism 250. Here, the registration rocking mechanism 250 of the lower driving roller 231*b* will be described as a representative of the pair of registration rollers 231. A rotational shaft 233 of the driving roller 231*b* is held in a manner rotatable by a bearing 234 and capable of being displaced in the axial direction. A hollow annular member 236 having an inner diameter larger than the diameter of the rotational shaft 233 is fit to the rotational shaft 233. The annular member 236 is sandwiched between a pair of C-shaped snap rings 235 attached to the rotational shaft 233, so that displacement of the annular member 236 relative to the rotational shaft 233 is restricted.

The annular member 236 has teeth 236*a* formed linearly along the axial direction on the surface thereof. The teeth 236*a* of the annular member 236 engage with a gear 237 attached to a motor shaft of a stepping motor 238. When the stepping motor 238 is rotated and driven in the positive direction or in the opposite direction, the driving force is transmitted to the rotational shaft 233 via the gear 237, the annular member 236, and the C-shaped snap rings 235 to rock the driving roller 231*b* in the direction perpendicular to the conveying direction of sheets S.

At the driving roller 231*b*, a gear 239 is attached to an end of the rotational shaft 233, and a gear 240 attached to the motor shaft of a motor 241 engages with the gear 239. For the gears 239 and 240, gears having spur wheels capable of being displaced in the thrust direction and having a large width (vertical size in FIG. 3) so that the engagement is maintained when the gears are displaced in the thrust direction by the rocking movement of the driving roller 231*b*. When the motor 241 is rotated and driven, the driving force is transmitted to the rotational shaft 233 via the gear 240 and 239 to rotate the driving roller 231*b*. In this process, the annular member 236 attached to the rotational shaft 233 by the C-shaped snap rings 235 does not rotate since the annular member 236 has an inner diameter larger than the diameter of the rotational shaft 233.

For transfer to a sheet such as a long sheet and a rolled paper having a large length in the conveying direction, the sheet is likely to meander owing to the differences in the roller diameter between the pair of registration rollers 231, the secondary transfer part 70, and the pair of fixing rollers 81. With the image forming apparatus 1 of the present embodiment, deviation of a sheet S such as a long sheet or rolled paper conveyed in a state being held between the pair of registration rollers 231, by the secondary transfer part 70, and between the pair of fixing rollers 81 at the same time can be detected. Then, the deviation of the sheet S can be corrected by rocking the pair of registration rollers 231 on the basis of a value detected by the sheet position detection sensor 90.

Furthermore, the position of an image to be written to the photosensitive member 41 can be adjusted within the range of the width W in FIG. 2 on the basis of a value detected by the sheet position detection sensor 90. With the present embodiment, since the deviation of a sheet S can be corrected and the position on the photosensitive member 41 to which an image is written can also be adjusted, the accuracy of the position of the image relative to the sheet can be stable.

[1-3. Method for Controlling Image Forming Apparatus (Image Forming Method)]

Figure 4:
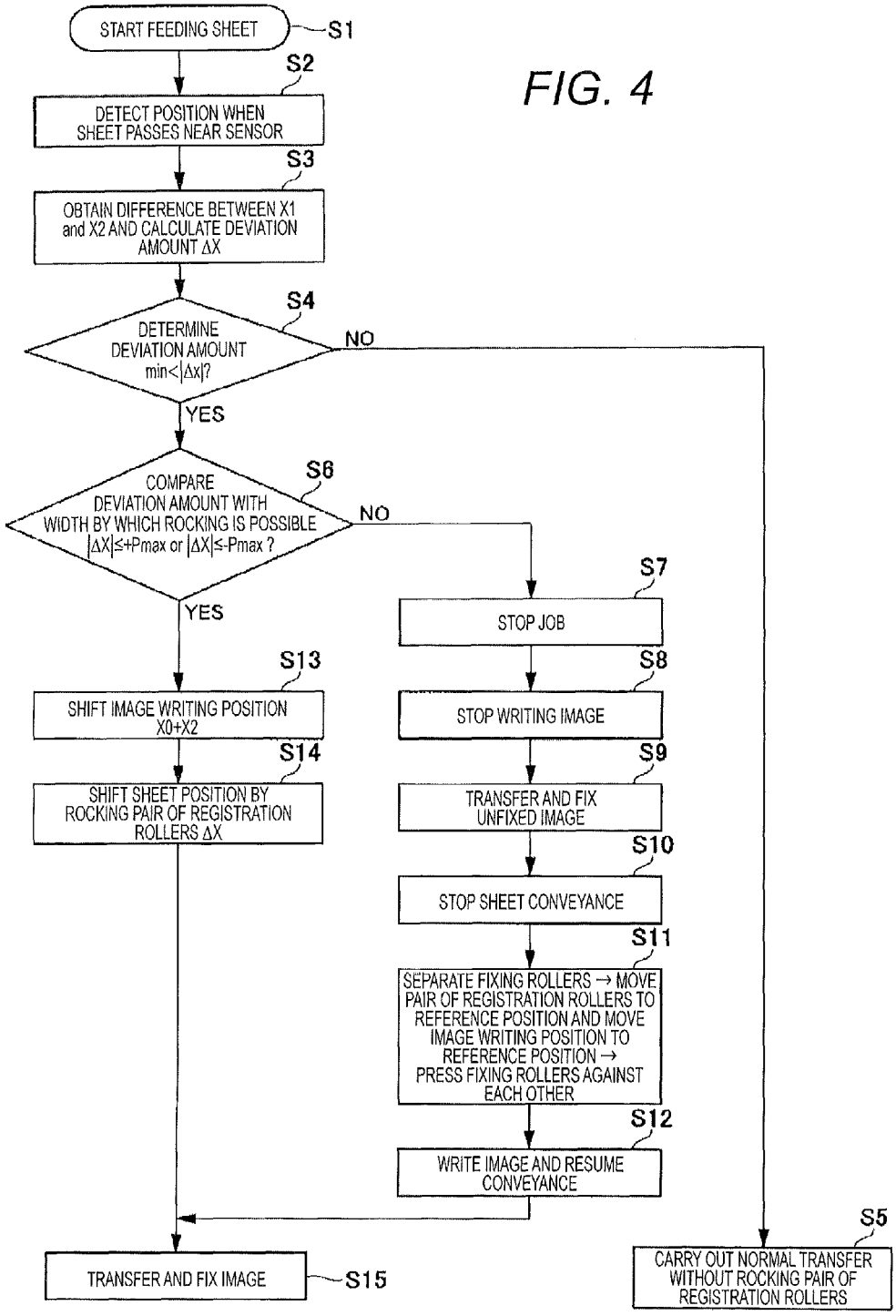
FIG. 4 is a flowchart showing a method for controlling the image forming apparatus according to the first embodiment.
Figure 5:
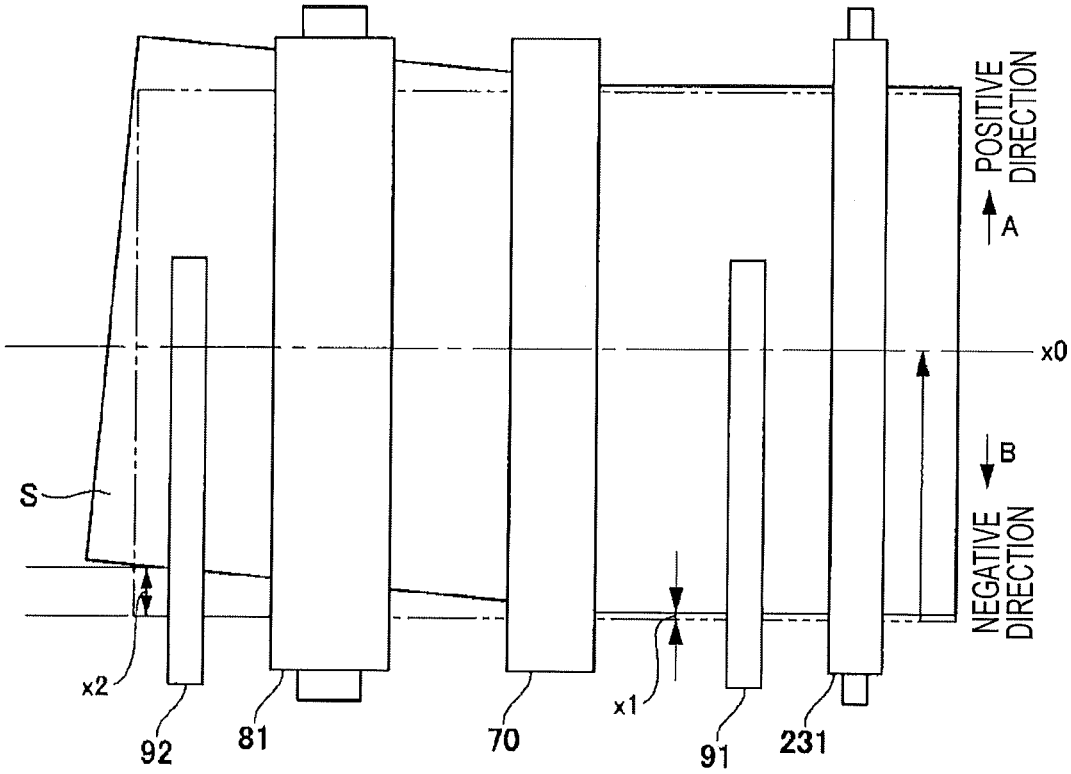
FIG. 5 is a diagram showing a state in which a sheet is meandering at a secondary transfer part and conveyed with a deviation to one side.

Next, a method for controlling the image forming apparatus 1 on the basis of a detected value detected by the sheet position detection sensor 90 will be described. FIG. 4 is a flowchart showing the method for controlling the image forming apparatus 1 according to the present embodiment. FIG. 5 is a diagram showing a state in which a sheet S is meandering at the secondary transfer part 70 and conveyed with a deviation to one side. In FIG. 5, a reference position (initial position) of the sheet S is shown by an alternate long and two short dashes line, and the position of the sheet S conveyed with a deviation is shown by a solid line.

When a job relating to image formation is started, the feeder 21 is operated, for example, to supply a sheet S from the sheet accommodation part 20, whereby sheet feeding is started (step S1).

After starting sheet feeding, the sheet S is conveyed by the conveyor 23 and stopped when an end of the sheet S comes into contact with the nip portion of the pair of registration rollers 231 that is stopped and not rotating. In this manner, the posture of the sheet S and the conveying timing are adjusted. Subsequently, the pair of registration rollers 231 is rotated and driven to convey the sheet S toward the secondary transfer part 70. When the sheet S passes through the secondary transfer part 70, a toner image is transferred from the intermediate transfer belt 50 to the sheet S, and the toner image is fixed to the sheet S when the sheet S on which the toner image is transferred passes through the nip portion of the pair of fixing rollers 81.

Subsequently, at a timing when the sheet S passes immediately below the first detection sensor 91 and the second detection sensor 92, the position of the sheet S is detected by the first detection sensor 91 and the second detection sensor 92 (step S2). In this process, the sheet S is in a state being held at three positions, which are the pair of registration rollers 231, the secondary transfer part 70, and the pair of fixing rollers 81.

The first detection sensor 91 detects the position of a side of the sheet S in the sheet width direction perpendicular to the conveying direction of the sheet S at a position near the pair of registration rollers 231 and downstream of the pair of registration rollers 231, and outputs the detection result to the controller 260. The second detection sensor 92 detects the position of a side of the sheet S in the sheet width direction perpendicular to the conveying direction of the sheet S at a position near the pair of fixing rollers 81 and downstream of the pair of fixing rollers 81, and outputs the detection result to the controller 260.

The controller 260 compares position information sent from the first detection sensor 91 and the second detection sensor 92 with reference position information to determine the deviated positions x1 and x2 of the sheet S at the respective positions. In this process, the deviated positions x1 and x2 are determined assuming that the deviated position is "positive" when the direction of deviation of the sheet relative to the reference position (initial position) is the positive direction in FIG. 5 and the deviated position is "negative" when the direction of deviation of the sheet S is the negative direction in FIG. 5, for example. Specifically, each of the deviated positions x1 and x2 is determined on the basis of the direction of deviation (direction of displacement) from the reference position and the amount of deviation (amount of displacement). The controller 260 then calculates the amounts of deviation Δx from the deviated positions x1 and x2 by the following expression (step S3).

$$\Delta x = x2 - x1$$

Subsequently, the controller 260 determines whether an absolute value |Δx| of the amount of deviation Δx is larger or smaller than a sheet adjustment minimum value min (step S4). The sheet adjustment minimum value min is determined to a range in which the positional correction of the sheet S is not needed, which is different depending on the specification of devices. In the present embodiment, the sheet adjustment minimum value min is set to 1 mm, for example. If |Δx| is equal to or smaller than the sheet adjustment minimum value min (determination to be "NO" in the step), the pair of registration rollers 231 is not rocked and normal transfer is carried out (step S5).

if |Δx| is larger than the sheet adjustment minimum value min (determination to be "YES" in the step), the controller 260 determines whether the absolute value of the deviation amount Δx is larger or smaller than the maximum width by which the pair of registration rollers 231 can be rocked (step S6).

If the deviation amount Δx is "positive", the pair of registration rollers 231 needs to be rocked in the positive direction in FIG. 5, and the maximum width +Pmax by which rocking in the positive direction is possible and |Δx| are compared. If the deviation amount Δx is "negative", the pair of registration rollers 231 needs to be rocked in the negative direction in FIG. 5, and the maximum width −Pmax by which rocking in the negative direction is possible and |Δx| are compared. Note that the maximum width by which the pair of registration rollers 231 can be rocked is about 5 mm in the positive direction and the negative direction from the initial position depending on the specification of devices.

If the deviation amount Δx is "positive" and |Δx|>+Pmax is satisfied, or if the deviation amount Δx is "negative" and |Δx|>−Pmax is satisfied (determination to be "NO" in step S4), the controller 260 stops the job (step S7).

Figure 6A:
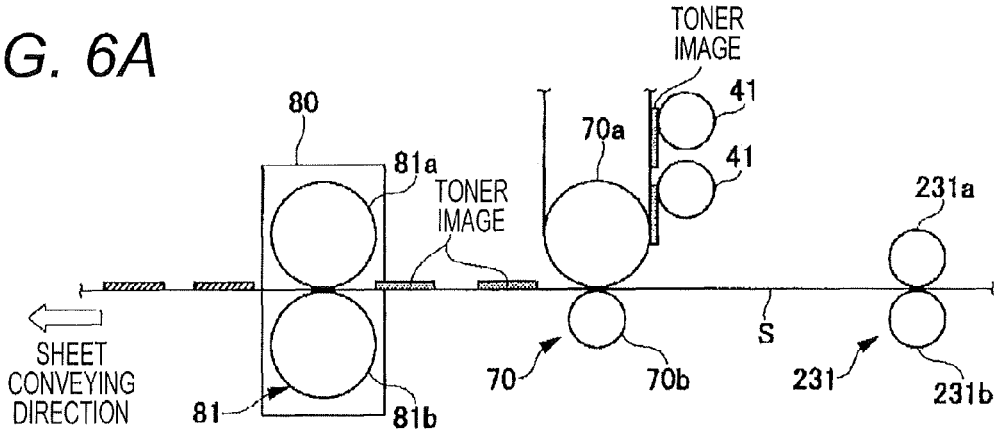
FIG. 6A is a diagram showing a state in which a sheet is conveyed during operation of a job.
Figure 6B:
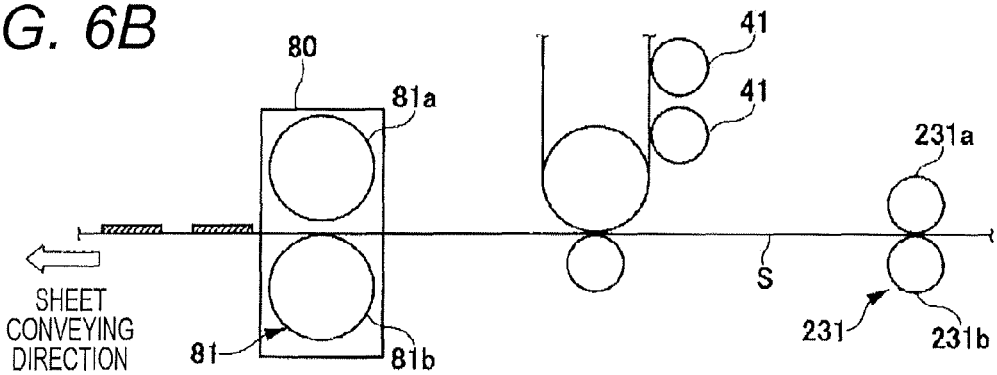
FIG. 6B is a diagram showing a state in which writing of an image onto a photosensitive member is stopped and the position of a sheet is reset during stop of a job.

FIG. 6A is a diagram showing a state in which a sheet S is conveyed during operation of a job. FIG. 6B is a diagram showing a state in which writing of an image onto the photosensitive member 41 is stopped and the position of a sheet S is reset during stop of a job.

As shown in FIG. 6A, during operation of a job, a toner image is transferred from the photosensitive member 41 to the intermediate transfer belt 50. The toner image transferred onto the intermediate transfer belt 50 is then transferred onto the sheet S at the secondary transfer part 70, and the toner image transferred onto the surface of the sheet S is heated and pressed to be fixed while passing through the nip portion between the pair of fixing rollers 81.

If the job is stopped, the controller 260 stops writing of image onto the photosensitive member 41 as shown in FIG. 6B (step S8). Subsequently, after transferring all of the unfixed toner images transferred to the intermediate transfer belt 50 onto the sheet S, the sheet S is conveyed to the pair of fixing rollers 81 to fix the toner image onto the sheet S (step S9). In this manner, no unfixed toner image remains on the intermediate transfer belt 50. The controller 260 then stops conveyance of the sheet S at a timing when the part onto which the last unfixed toner image is transferred is discharged from the pair of fixing rollers 81 (step S10).

After stopping sheet conveyance, the controller 260 separates the lower fixing roller 81*b* and the upper fixing roller 81*a* constituting the pair of fixing rollers 81 from each other as shown in FIG. 6B. Subsequently, if the position of the pair of registration rollers 231 and the position on the photosensitive member 41 to which the image is to be written are changed from the reference positions as a result of rocking of the pair of registration rollers 231 and correction of the position to which the image is to be written, which will be described later, the controller 260 returns these positions to the reference positions and presses the pair of fixing rollers 81 against each other again (step S11). As a result, the deviation of the sheet S is once reset, and the sheet S is held between the pair of fixing rollers 81, by the secondary transfer part 70, and between the pair of registration rollers 231 at the reference position. The controller 260 then starts writing of the image onto the photosensitive member 41 and conveying the sheet S (step S12), and transfer and fix the toner image (step S15).

If the deviation amount Δx is "positive" and |Δx|≤+Pmax is satisfied, or if the deviation amount Δx is "negative" and |Δx|≤−Pmax is satisfied (determination to be "YES" in step S4), the controller 260 performs control to shift the position on the photosensitive member 41 to which the image is to be written with the shift of the sheet S. As will be described later, the sheet S is shifted by rocking the pair of registration rollers 231 and according to the deviation detected by the second detection sensor 92. Thus, the sheet S comes to a position shifted in parallel by the deviation amount x2 from the reference center position x0. The position on the photosensitive member 41 to which the image is to be written is then shifted to a position where the center position of the image is to be written is x0+x2 (step S13).

Subsequently, the controller 260 performs rocking of the pair of registration rollers 231 on the basis of the deviation amount Δx (step S14). The rocking of the pair of registration rollers 231 is performed in a state in which the sheet S is nipped by the nip portion between the pair of the registration rollers 231. If the deviation amount Δx is "positive", the controller 260 rocks the pair of registration rollers 231 by |Δx| in the positive direction. If the deviation amount Δx is "negative", the controller 260 rocks the pair of registration rollers 231 by |Δx| in the negative direction.

The rocking of the pair of registration rollers 231 is preferably performed while no toner image to be transferred to the sheet S at the secondary transfer part 70 is formed on the intermediate transfer belt 50, that is during a non-image period. As a result of rocking the pair of registration rollers 231 during a non-image period, the position to which a toner image is transferred can be prevented from being deviated.

Furthermore, the rocking speed of the pair of registration rollers 231 is preferably subjected to variable control depending on the non-image period. For example, if the non-image period is long and the width of a non-image formed part in which no toner image is formed is large, the rocking speed of the pair of registration rollers 231 is made as low as possible, so that the rocking ends immediately before a next toner image is transferred onto the sheet S. As a result of making the rocking speed low, wrinkles of the sheet S that may be caused as the sheet S is shifted can be prevented. Conversely, if the non-image period is short and the width of the non-image formed part is small, the rocking speed of the pair of registration rollers 231 is made as high as possible, so that the rocking ends immediately before a next toner image is transferred onto the sheet S.

Figure 7:
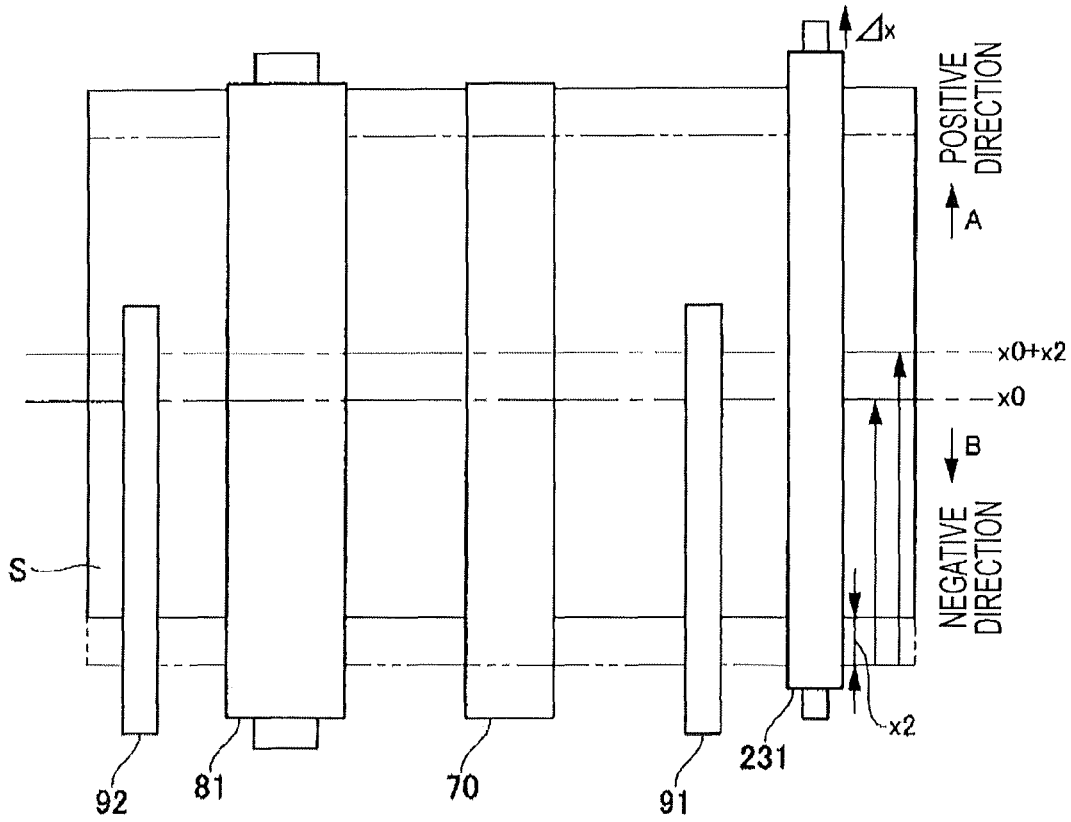
FIG. 7 is a diagram showing a state after a pair of registration rollers is rocked.

FIG. 7 is a diagram showing a state after the pair of registration rollers 231 is rocked. As shown in FIG. 7, as a result of rocking the pair of registration rollers 231 to shift the sheet S, the deviation of the sheet S is corrected referring to the deviation amount x2 near the pair of fixing rollers 81. Specifically, the sheet S is entirely shifted in parallel to the axial direction of the pair of registration rollers 231 by x2 from the reference position.

After shifting of the sheet S is finished, the toner image is transferred and fixed. The toner image to be transferred at the secondary transfer part 70 after the sheet S is shifted is an image for which the position on the photosensitive member 41 to write to is shifted. Thus, at the secondary transfer part 70, writing is carried out at a proper position on the sheet S. Furthermore, since the deviation of the sheet S is also corrected, variation in the image position on the sheet S and the like are also suppressed.

The detection of the position of the sheet S by the sheet position detection sensor 90 as described above is performed every 1 second, for example, which depends on the size and the specification of devices, and the processes of steps S4 to S15 described with reference to FIG. 4 are repeated. As a result, during the period in which a toner image is transferred onto one sheet S, the position on the sheet S to which the toner image is transferred can be kept optimum. Furthermore, when the pair of registration rollers 231 is rocked, the maximum widths +Pmax and −Pmax by which the rocking is possible change from initial values as needed. When |Δx| and +Pmax or |Δx| and −Pmax is compared in step S6, the maximum widths the maximum widths by which the pair of registration rollers 231 can be rocked in the positive direction and in the negative direction at this point are set as new +Pmax and −Pmax.

With the image forming apparatus 1 of the present embodiment, as a result of arranging the first detection sensor 91 is near the pair of registration rollers 231 and arranging the second detection sensor 92 near the pair of fixing rollers 81, meandering of a long sheet or a rolled paper can be detected. In addition, as a result of rocking the pair of registration rollers 231 on the basis of a difference between values detected by the first detection sensor 91 and the second detection sensor 92, correction can be made so that a side of a sheet in the width direction perpendicular to the conveying direction becomes parallel to the sheet conveying direction even when the sheet meanders while being conveyed.

Furthermore, with the image forming apparatus 1 of the present embodiment, the position on the photosensitive member 41 to which an image is to be written is also corrected on the basis of values detected by the first detection sensor 91 and the second detection sensor 92. As a result, variation in the image position relative to a sheet is suppressed, which improves the accuracy of the image position. Furthermore, the correction of the image position may be performed to change the center position of the image to be written relative to the photosensitive member 41, and adjustment of the image angle and the like is not necessary. It is therefore easy to control writing of an image.

2. Second Embodiment

Image Forming Apparatus Configured to Correct Position of Sheet by Rocking Pair of Registration Rollers and Pair of Fixing Rollers

[2-1. Configuration of Main Part]

Figure 8:
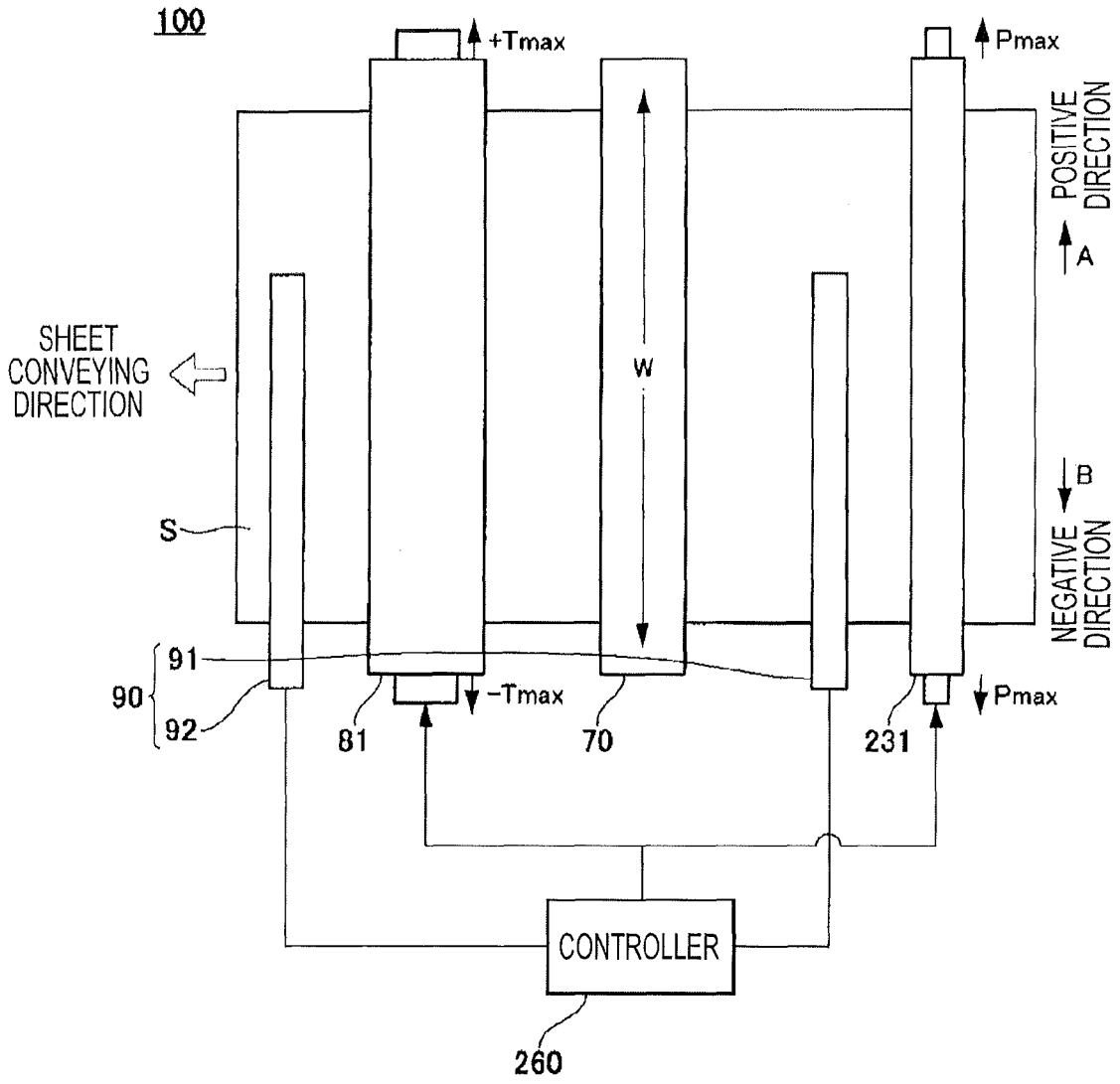
FIG. 8 is a top view of a main part including a sheet position detection sensor according to a second embodiment, which is partially shown in a block diagram.

Next, an image forming apparatus according to a second embodiment will be described. FIG. 8 is a top view of a main part of the image forming apparatus 100 of the present embodiment including the sheet position detection sensor 90. The image forming apparatus 100 of the present embodiment differs from that of the first embodiment in that the pair of fixing rollers 81 is also rocked for correction of the position of a sheet S. Since the other components are the same as those in the first embodiment, parts in FIG. 8 corresponding to those in FIG. 2 are designated by the same reference numerals and redundant description will not be repeated. In addition, since the overall configuration of the image forming apparatus 100 of the present embodiment is the same as that in FIG. 1, the image forming apparatus 100 is not shown.

Although not shown in FIG. 8, a fixing roller rocking mechanism to rock the pair of fixing rollers 81 in the direction perpendicular to the conveying direction of sheets S is provided at an end of a shaft of each of the rollers constituting the pair of fixing rollers 81. Since the configuration of the fixing roller rocking mechanism is the same as the registration rocking mechanism described with reference to FIG. 3, the fixing roller rocking mechanism is not shown and redundant description thereof will not be repeated. For easier understanding of the description, the direction indicated by an arrow A in FIG. 8 will be referred to as a positive direction and the direction indicated by an arrow B will be referred to as a negative direction.

The fixing roller rocking mechanisms thus rock the pair of fixing rollers 81 in the axial direction on the basis of a signal sent from the controller 260. Herein, a maximum width by which the pair of fixing rollers 81 can be rocked in the positive direction is represented by +Tmax, and a maximum width by which the pair of fixing rollers 81 can be rocked in the negative direction is represented by −Tmax. In the following description, the maximum widths +Tmax and −Tmax are assumed to be "positive" values.

In the image forming apparatus 100 of the present embodiment, both of the pair of registration rollers 231 and the pair of fixing rollers 81 are attached in a manner capable of being rocked. Thus, as a result of rocking the pair of registration rollers 231 in the positive direction and rocking the pair of fixing rollers 81 in the negative direction, for example, the range of the deviation amount Δx that can be adjusted when the sheet S is deviated in the positive direction can be enlarged up to (+Pmax)+(−Tmax). Similarly, as a result of rocking the pair of registration rollers 231 in the negative direction and rocking the pair of fixing rollers 81 in the positive direction, the range of the deviation amount Δx that can be adjusted when the sheet S is deviated in the negative direction can be enlarged up to (−Pmax)+(+Tmax).

[2-2. Method for Controlling Image Forming Apparatus (Image Forming Method)]

Figure 9:
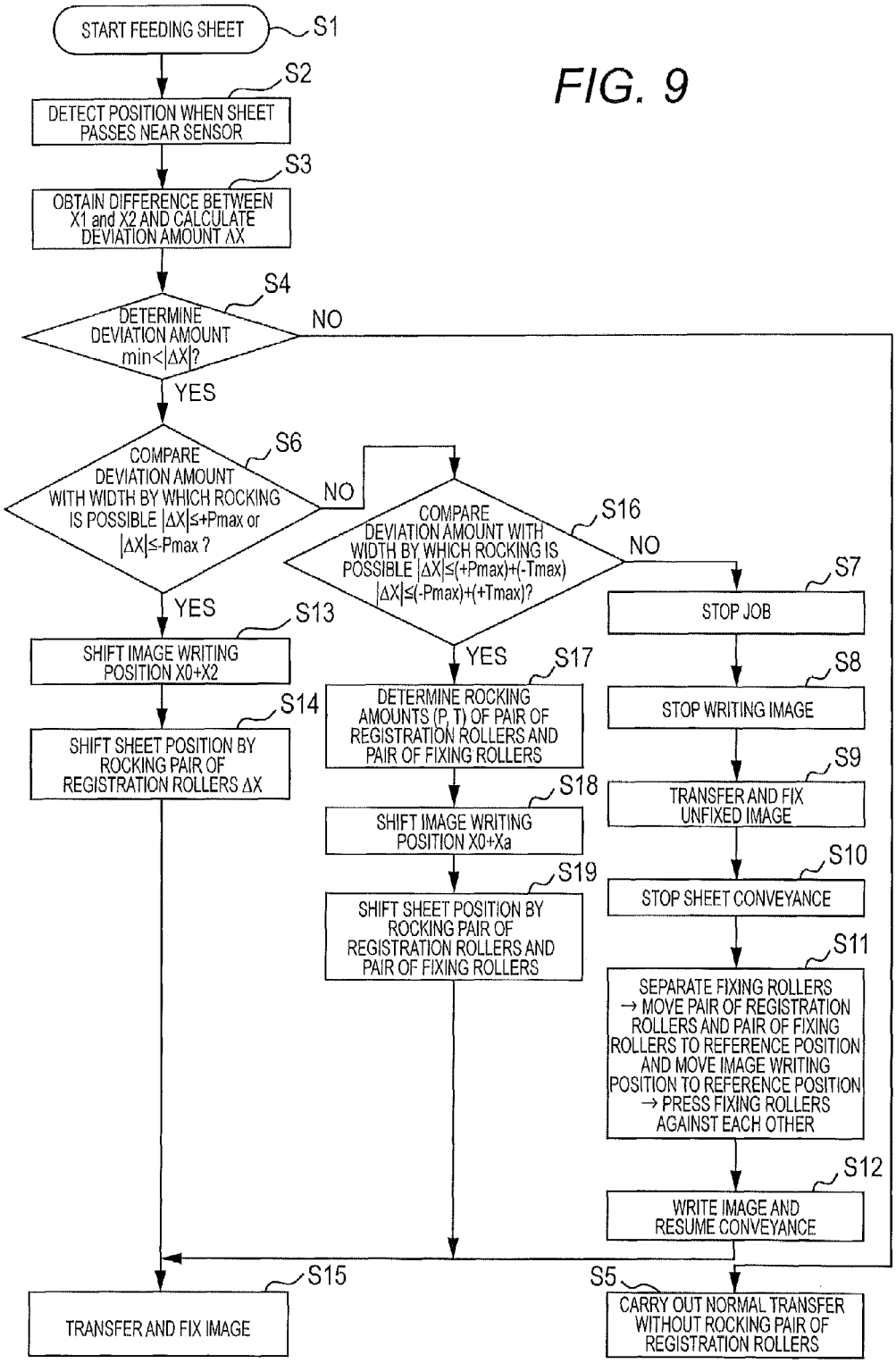
FIG. 9 is a flowchart showing a method for controlling an image forming apparatus according to the second embodiment.
Figure 10:
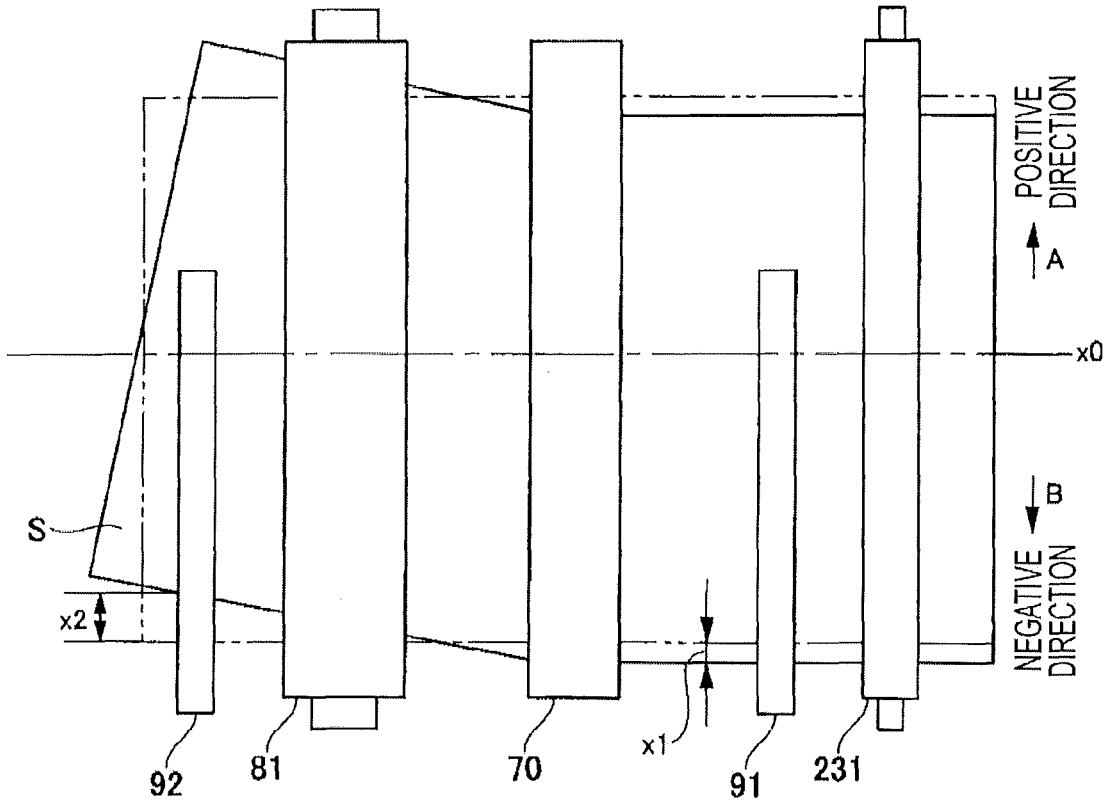
FIG. 10 is a diagram showing a state in which a sheet is meandering at a secondary transfer part and conveyed with a deviation to one side.

Next, a method for controlling an image forming apparatus 100 on the basis of a detected value detected by the sheet position detection sensor 90 will be described. FIG. 9 is a flowchart showing the method for controlling the image forming apparatus 100 according to the present embodiment. FIG. 10 is a diagram showing a state in which a sheet S is meandering at the secondary transfer part 70 and conveyed with a deviation to one side. In FIG. 10, a reference position (initial position) of the sheet S is shown by an alternate long and two short dashes line, and the position of the sheet S conveyed with a deviation is shown by a solid line.

The image forming method of the present invention differs from that of the first embodiment in the process after the determination that the deviation amount Δx is "positive" and |Δx|>+Pmax is satisfied or that the deviation amount Δx is "negative" and |Δx|>−Pmax is satisfied (determination to be "NO" in step S4). Since steps S1 to S5 in FIG. 9 are thus the same as those in the first embodiment described with reference to FIG. 4, redundant description will not be repeated and the description will be made from step S6.

If it is determined to be "NO" in step S6, the controller 260 determines whether the absolute value |Δx| of the deviation amount Δx is larger or smaller than the sum of the maximum width by which the pair of registration rollers 231 can be rocked and the maximum width by which the pair of fixing rollers 81 can be rocked.

Here, if the deviation amount Δx is "positive", the pair of registration rollers 231 needs to be rocked in the positive direction in FIG. 10 and the pair of fixing rollers 81 needs to be rocked in the negative direction, and (+Pmax)+(−Tmax) and |Δx| are thus compared. If the deviation amount Δx is "negative", the pair of registration rollers needs to be rocked in the negative direction in FIG. 10 and the pair of fixing rollers 81 needs to be rocked in the positive direction, and (−Pmax)+(+Tmax) and |Δx| are thus compared.

If the deviation amount Δx is "positive" and |Δx|>(+Pmax)+(−Tmax) is satisfied, or if the deviation amount Δx is "negative" and |Δx|>(−Pmax)+(+Tmax) is satisfied (determination to be "NO" in step 316), the controller 260 stops the job (step S7).

Subsequently, the controller 260 stops writing of the image onto the photosensitive member 41 (step S8), transfers all of the unfixed toner images transferred to the intermediate transfer belt 50 onto the sheet S, and then conveys the sheet S to the fixing part 80, where the toner image is fixed onto the sheet S (step S9). In this manner, no unfixed toner image remains on the intermediate transfer belt 50. The controller 260 then stops conveyance of the sheet S at a timing when the part onto which the last unfixed toner image is transferred is discharged from the pair of fixing rollers 81 (step S10).

After stopping the sheet conveyance, the controller 260 separates the pair of fixing rollers 81 of the fixing part 80 from each other as shown in FIG. 6B, returns the pair of registration rollers 231 and the pair of fixing rollers 81 to the reference positions, and also returns the position on the photosensitive member 41 to which the image is to be written to the reference position. Furthermore, the controller 260 presses the pair of fixing rollers 81 against each other again (step S11) As a result, the deviation of the sheet S is once reset, and the sheet S is held between the pair of fixing rollers 81, by the secondary transfer part 70, and between the pair of registration rollers 231 at the reference position. The controller 260 then starts writing of the image onto the photosensitive member 41 and conveying the sheet S (step S12), and transfer and fix the toner image (step S15).

If the deviation amount Δx is "positive" and |Δx|≤(+Pmax)+(−Tmax) is satisfied, or if the deviation amount Δx is "negative" and |Δx|≤(−Pmax)+(+Tmax) is satisfied (determination to be "YES" in step S16), the controller 260 performs the following processes.

First, the controller 260 determines a rocking direction and a rocking amount P of the pair of registration rollers 231 and a rocking direction and a rocking amount T of the pair of fixing rollers 81. The pair of registration rollers 231 and the pair of fixing rollers 81 are always rocked in the opposite directions so as to correct the deviation amount Δx. Furthermore, to correct the deviation amount Δx to zero, the rocking amounts P and T that satisfy |Δx|=|P|+|T| are determined (step S17).

Subsequently, the controller 260 calculates the center position xa of the image to be shifted by rocking of the sheet S, and shifts the position on the photosensitive member 41 to which the image is to be written is shifted so that the center position of the image comes to the center position xa (step S18).

Subsequently, the controller 260 carries out rocking of the pair of registration rollers 231 and the pair of fixing rollers 81 on the basis of the rocking amounts P and T determined in step S17 (step S19). The rocking of the pair of registration rollers 231 and the pair of fixing rollers 81 is performed in a state in which the sheet S is nipped by the nip portions between the respective pairs of rollers. In this manner, the deviation of the sheet S is corrected. The rocking speed and the rocking timing in this process are the same as those in the first embodiment.

Furthermore, rocking of the pair of registration rollers 231 and rocking of the pair of fixing rollers 81 may be performed at the same time or separately.

Figure 11:
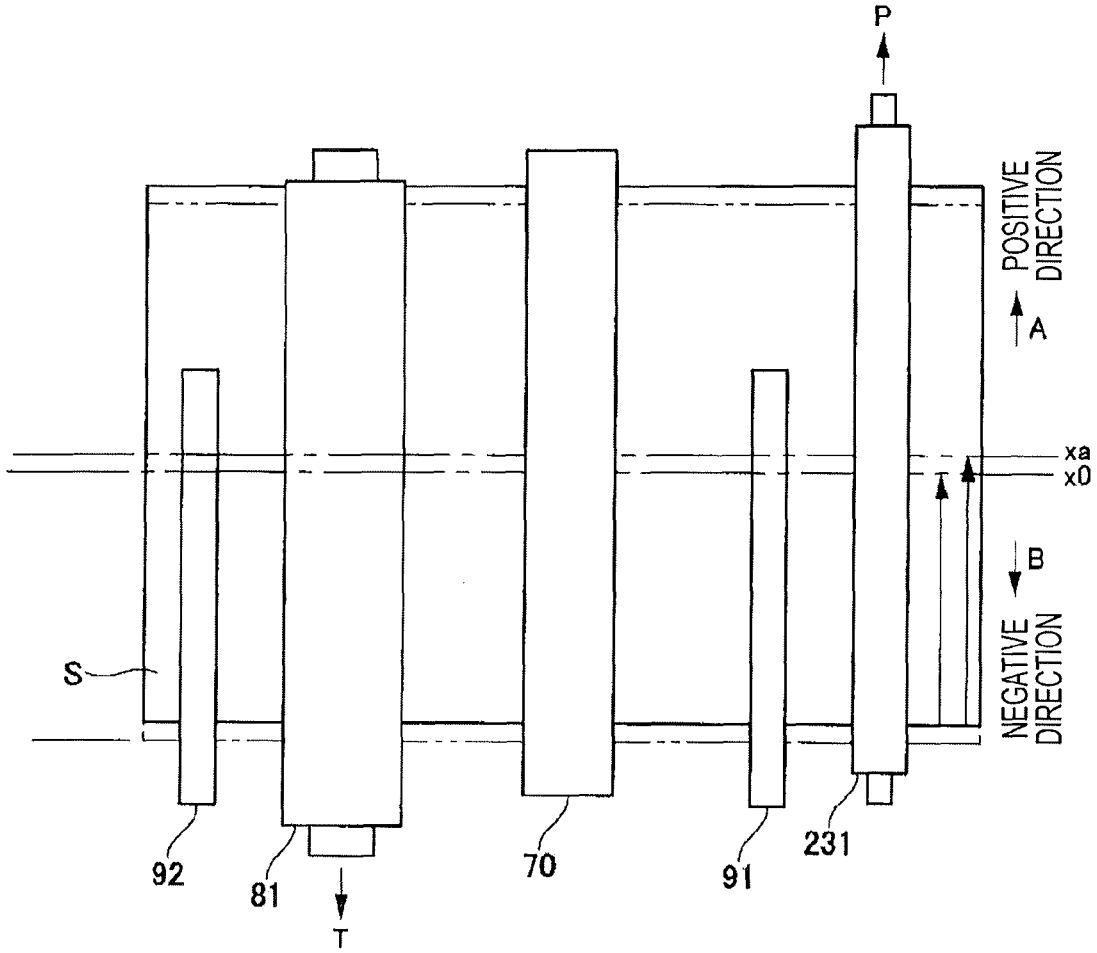
FIG. 11 is a diagram showing a state after a pair of registration rollers and a pair of fixing rollers are rocked.

FIG. 11 is a diagram showing a state after the pair f registration rollers 231 and the pair of fixing rollers 81 are rocked. As shown in FIG. 11, the sheet S is shifted in the positive direction by the rocking amount P near the pairs of registration rollers 231 and shifted in the negative direction by the rocking amount T near the pair of fixing rollers 81 to correct the deviation.

After shifting of the sheet S is finished, the toner image is transferred and fixed (step S15). The toner image to be transferred at the secondary transfer part 70 after the sheet S is shifted is an image for which the position on the photosensitive member 41 to write to is shifted. Thus, at the secondary transfer part 70, writing is carried out at a proper position on the sheet S. Furthermore, since the deviation of the sheet S is also corrected, variation in the image position on the sheet S and the like are also suppressed.

In the present embodiment, the detection of the position of the sheet S is also performed every 1 second, for example, and the processes of steps S2 to S19 described with reference to FIG. 9 are repeated, which allows the position on the sheet S to which the toner image is transferred to be kept optimum during the period in which a toner image is transferred onto one sheet S. Furthermore, when the pair of registration rollers 231 and the pair of fixing rollers 81 are rocked, the maximum widths +Pmax, −Pmax, +Tmax, and −Tmax by which the rocking is possible change from initial values. When |Δx| and +Pmax or |Δx| and −Pmax is compared in step S6, the maximum widths the maximum widths by which rocking is possible in the positive direction and in the negative direction at this point are set as new +Pmax and −Pmax. Thus, when +Pmax or −Pmax is "0" in step S6 and the process proceeds to step S16, only the pair of fixing rollers 81 is rocked.

In the present embodiment, when the deviation amount Δx of the sheet S is large, the pair of fixing rollers 81 is also rocked in addition to the pair of registration rollers 231 to correct the deviation of the sheet S. Furthermore, since the pair of registration rollers 231 and the pair of fixing rollers 81 are rocked always in directions different from each other, the width of shift of the sheet S can be made smaller than the case in which the sheet S is shifted by only using the pair of registration rollers 231. As a result, an advantageous effect that wrinkles of the sheet S that may be caused by shifting the sheets S can be suppressed is produced. In addition, the same advantageous effects as those in the first embodiment can also be produced in the present embodiment.

Although the first and second embodiments have been described using the "pair of registration rollers" as the "pair of pre-transfer rollers" and the "secondary transfer part" as the "transfer part" of the present invention, the present invention is not limited thereto. The present invention can be applied to any configuration including a transfer part in which an unfixed toner image is transferred, a pair of fixing rollers to fix the toner image transferred in the transfer part, and a pair of pre-transfer rollers arranged upstream of the transfer part.

Furthermore, although an example in which the second detection sensor is provided downstream of a pair of fixing rollers is described in the first and second embodiments, the second detection sensor may be provided at any position downstream of the secondary transfer part (transfer part), such as between the pair of fixing rollers and the secondary transfer part. As a result of providing the second detection sensor downstream of the pair of fixing rollers as in the first and second embodiments, a larger deviation can be detected, which can improve the correction accuracy.

Furthermore, although an example of a color image forming apparatus is described in the first and second embodiments, the present invention can also be applied to a monochromatic image forming apparatus. Furthermore, the image forming apparatus is not limited to a copier, but may be a printer, a facsimile machine, or a multifunction machine having multiple functions.

According to the above embodiments, the accuracy of the image position with respect to a recording medium can be maintained even when the recording medium meanders.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a transfer part configured to transfer an unfixed toner image transferred from a photosensitive member onto a recording medium;

a pair of pre-transfer rollers provided upstream of the transfer part and configured to convey a recording medium toward the transfer part;

a fixing part provided downstream of the transfer part and configured to make the recording medium onto which the toner image is transferred pass between a pair of fixing rollers to fix the toner image onto the recording medium;

a first detection sensor provided between the transfer part and the pair of pre-transfer rollers and configured to detect a position of the recording medium between the transfer part and the pair of pre-transfer rollers;

a second detection sensor provided downstream of the transfer part and configured to detect a position of the recording medium downstream of the pair of pre-transfer rollers; and a controller configured to calculate a deviation amount of the recording medium from values detected by the first detection sensor and the second detection sensor, rock the pair of pre-transfer rollers and adjust a position to which an image is written to form a toner image on the photosensitive member on the basis of the deviation amount.

2. The image forming apparatus according to claim 1, wherein the deviation amount is a difference between a deviation position of the recording medium calculated from a value detected by the first detection sensor and a deviation value of the recording medium calculated from a value detected by the second detection sensor.

3. The image forming apparatus according to claim 1, wherein the rocking of the pair of pre-transfer rollers is carried out during a non-image period in which no toner image is transferred from the transfer part to the recording medium.

4. The image forming apparatus according to claim 3, wherein a rocking speed of the pair of pre-transfer rollers is varied depending on the non-image period.

5. The image forming apparatus according to claim 1, wherein when the deviation amount exceeds a range in which the pair of pre-transfer rollers can be rocked, a job is stopped.

6. The image forming apparatus according to claim 5, wherein the stopping of the job is carried out after the entire toner image is transferred onto the recording medium and the toner image is fixed onto the recording medium by the pair of fixing rollers.

7. The image forming apparatus according to claim 5, wherein after stopping the job, the pair of fixing rollers are separated from each other, and a position of the pair of pre-transfer rollers is returned to an initial position.

8. The image forming apparatus according to claim 1, wherein the controller rocks the pair of fixing rollers on the basis of the deviation amount.

9. An image forming system comprising:

a transfer part configured to transfer an unfixed toner image transferred from a photosensitive member onto a recording medium;

a pair of pre-transfer rollers provided upstream of the transfer part to convey a recording medium toward the transfer part;

a fixing part provided downstream of the transfer part and configured to make the recording medium onto which the toner image is transferred pass between a pair of fixing rollers to fix the toner image onto the recording medium;

a first detection sensor provided between the transfer part and the pair of pre-transfer rollers and configured to detect a position of the recording medium between the transfer part and the pair of pre-transfer rollers;

a second detection sensor provided downstream of the transfer part and configured to detect a position of the recording medium downstream of the pair of pre-transfer rollers; and a controller configured to calculate a deviation amount of the recording medium from values detected by the first detection sensor and the second detection sensor, rocks the pair of pre-transfer rollers and adjusts a position to which an image is written to form a toner image on the photosensitive member on the basis of the deviation amount.

10. An image forming method comprising:

detecting a position of a recording medium held by a transfer part configured to transfer an unfixed toner image transferred from a photosensitive member onto a recording medium, between a pair of pre-transfer rollers provided upstream of the transfer part to convey a recording medium toward the transfer part, and between a pair of fixing rollers to fix the toner image onto the recording medium, by a first detection sensor provided between the transfer part and the pair of pre-transfer rollers and a second detection sensor provided downstream of the transfer part;

calculating a deviation amount of the recording medium from values detected by the first detection sensor and the second detection sensor; and rocking the pair of pre-transfer rollers and adjusting a position on the photosensitive member to which an image is to be written on the basis of the deviation amount.

11. The image forming method according to claim 10, wherein the deviation amount is calculated by obtaining a difference between a deviation position of the recording medium calculated from a value detected by the first detection sensor and a deviation value of the recording medium calculated from a value detected by the second detection sensor.

12. The image forming method according to claim 10, wherein the rocking of the pair of pre-transfer rollers is carried out during a non-image period in which no toner image is transferred from the transfer part to the recording medium.

13. The image forming method according to claim 12, wherein a rocking speed of the pair of pre-transfer rollers is varied depending on the non-image period.

14. The image forming method according to claim 10, wherein when the deviation amount exceeds a range in which the pair of pre-transfer rollers can be rocked, a job is stopped.

15. The image forming method according to claim 14, wherein the stopping of the job is carried out after the entire toner image carried by the transfer part is transferred onto the recording medium and the toner image is fixed onto the recording medium by the pair of fixing rollers.

16. The image forming method according to claim 15, wherein after stopping the job, the pair of fixing rollers are separated from each other, and a position of the pair of pre-transfer rollers is returned to an initial position.

17. The image forming method according to claim 10, wherein the pair of fixing rollers is rocked on the basis of the deviation amount.

* * * * *